US007014733B2

(12) United States Patent
Gustafson et al.

(10) Patent No.: US 7,014,733 B2
(45) Date of Patent: Mar. 21, 2006

(54) BELT FOR SHOE PRESS AND SHOE CALENDER AND METHOD FOR FORMING SAME

(75) Inventors: Eric J. Gustafson, Stephens City, VA (US); Matthew Vosika, Middletown, VA (US); Michael D. Madden, Winchester, VA (US)

(73) Assignee: Stowe Woodward L.L.C., Middletown, VA (US)

( * ) Notice: Subject to any disclaimer, the term of this patent is extended or adjusted under 35 U.S.C. 154(b) by 152 days.

(21) Appl. No.: 10/428,406

(22) Filed: May 5, 2003

(65) Prior Publication Data

US 2004/0219346 A1 Nov. 4, 2004

Related U.S. Application Data

(60) Provisional application No. 60/378,146, filed on May 14, 2002.

(51) Int. Cl.
*D21F 3/04* (2006.01)

(52) U.S. Cl. ..... 162/358.4; 162/901; 428/105; 428/295.4; 428/300.7; 428/301.4; 428/909; 156/169; 156/176; 156/177

(58) Field of Classification Search ..... 162/203–207, 162/306, 348, 358.1, 358.2, 358.3, 358.4, 162/360, 361, 900–904; 428/292.1, 293.7, 428/295.4, 300.7, 301.4, 909, 105–112; 198/846; 264/171.13, 171.24, 172.19, 212, 213, 216, 264/241, 271.1, 279, 279.1, 308, 310, 319; 156/166, 169, 172–181

See application file for complete search history.

(56) References Cited

U.S. PATENT DOCUMENTS

| | | | | |
|---|---|---|---|---|
| 4,224,372 | A | 9/1980 | Romanski | 428/257 |
| 4,229,253 | A | 10/1980 | Cronin | 162/358 |
| 4,229,254 | A | 10/1980 | Gill | 162/358 |
| 4,238,287 | A | 12/1980 | Gill | 162/358 |
| 4,446,187 | A | 5/1984 | Eklund | 428/136 |
| 4,552,620 | A | 11/1985 | Adams | 162/358 |
| 4,559,258 | A | 12/1985 | Kiuchi | 428/156 |
| 4,643,916 | A | 2/1987 | Kiuchi | 427/176 |
| 4,673,461 | A | 6/1987 | Roerig et al. | 162/205 |
| 4,674,622 | A | 6/1987 | Utsunomiya et al. | 198/500 |

(Continued)

FOREIGN PATENT DOCUMENTS

DE 41 25 470 11/1992

(Continued)

OTHER PUBLICATIONS

PCT International Search Report for PCT/US03/15319.

*Primary Examiner*—Eric Hug
(74) *Attorney, Agent, or Firm*—Myers Bigel Sibley & Sajovec

(57) ABSTRACT

A method of producing an endless belt includes the steps of: securing axial fibers relative to a mandrel, the axial fibers being spaced apart from one another at desired intervals and extending substantially parallel to a longitudinal axis of the mandrel; applying a polymeric base layer to the mandrel in a thickness sufficient to embed the axial fibers; wrapping circumferential fibers onto the polymeric base layer with sufficient tension to partially embed the circumferential fibers in the polymeric base layer; applying a polymeric top stock layer over the polymeric base layer and circumferential fibers; and curing the base layer and the top stock layer. This method can improve productivity and performance of endless belts, particularly if the wrapping and latter applying steps closely follow the first applying step.

27 Claims, 6 Drawing Sheets

U.S. PATENT DOCUMENTS

| | | | | | |
|---|---|---|---|---|---|
| 4,701,368 | A | | 10/1987 | Kiuchi et al. | 428/233 |
| 4,787,946 | A | | 11/1988 | Romanski | 156/137 |
| 4,812,185 | A | | 3/1989 | Romanski | 156/86 |
| RE33,034 | E | | 8/1989 | Schiel et al. | 241/119 |
| 4,859,396 | A | | 8/1989 | Krenkel et al. | 264/311 |
| 4,861,434 | A | | 8/1989 | Bonander et al. | 162/358 |
| 4,877,472 | A | | 10/1989 | Rodal | 156/184 |
| 4,878,281 | A | | 11/1989 | Flamig et al. | 29/116.1 |
| 4,880,501 | A | | 11/1989 | Schiel | 162/358 |
| 4,889,674 | A | | 12/1989 | Krenkel et al. | 264/130 |
| 4,908,103 | A | | 3/1990 | Cronin et al. | 162/358 |
| 4,944,089 | A | | 7/1990 | Flamig et al. | 29/895 |
| 4,944,844 | A | | 7/1990 | Marcinko | 162/205 |
| 4,946,731 | A | | 8/1990 | Dutt | 428/156 |
| 4,973,383 | A | | 11/1990 | Filzen | 162/358 |
| 4,975,152 | A | | 12/1990 | Filzen et al. | 162/358 |
| 4,978,428 | A | * | 12/1990 | Cronin et al. | 162/358.4 |
| 4,981,721 | A | | 1/1991 | Krenkel et al. | 427/171 |
| 4,984,467 | A | | 1/1991 | Haefner | 73/721 |
| 5,062,924 | A | | 11/1991 | McCarten et al. | 162/358 |
| 5,107,625 | A | | 4/1992 | Steiner et al. | 51/216 R |
| 5,118,391 | A | * | 6/1992 | Matuschczyk et al. | 162/358.4 |
| 5,132,141 | A | | 7/1992 | Schon | 427/171 |
| 5,134,010 | A | * | 7/1992 | Schiel | 428/113 |
| 5,167,771 | A | | 12/1992 | Sayers et al. | 162/358.4 |
| 5,196,092 | A | | 3/1993 | Stigberg | 162/358.4 |
| 5,208,087 | A | | 5/1993 | Stigberg | 428/60 |
| 5,234,551 | A | | 8/1993 | Dutt et al. | 162/358.4 |
| 5,238,537 | A | | 8/1993 | Dutt | 162/358.4 |
| 5,290,164 | A | | 3/1994 | Schiel | 425/111 |
| 5,298,124 | A | | 3/1994 | Eklund et al. | 162/306 |
| 5,302,251 | A | | 4/1994 | Schiel et al. | 162/358.4 |
| 5,320,702 | A | | 6/1994 | Matuschczyk et al. | 156/429 |
| 5,342,486 | A | | 8/1994 | Jeffery et al. | 162/358.4 |
| 5,501,133 | A | | 3/1996 | Brookstein et al. | 87/33 |
| 5,525,194 | A | | 6/1996 | Jermo | 162/358.4 |
| 5,543,015 | A | | 8/1996 | Jermo | 162/358.4 |
| 5,601,877 | A | | 2/1997 | Miller et al. | 427/373 |
| 5,609,811 | A | * | 3/1997 | Jermo | 264/255 |
| 5,753,085 | A | | 5/1998 | FitzPatrick | 162/358.4 |
| 5,766,421 | A | * | 6/1998 | Aufrecht | 162/358.4 |
| 5,772,848 | A | | 6/1998 | Dutt | 162/358.4 |
| 5,789,052 | A | | 8/1998 | Miller et al. | 428/57 |
| 5,833,898 | A | | 11/1998 | Dutt | 264/102 |
| 5,836,242 | A | * | 11/1998 | Aberg | 100/327 |
| 5,965,208 | A | | 10/1999 | Fagerholm et al. | 427/428 |
| 5,968,318 | A | * | 10/1999 | Hasegawa et al. | 162/358.4 |
| 6,027,615 | A | | 2/2000 | Davenport et al. | 162/358.2 |
| 6,030,503 | A | | 2/2000 | Matuschczyk | 162/358.2 |
| 6,036,819 | A | | 3/2000 | Miller et al. | 162/358.2 |
| 6,086,719 | A | * | 7/2000 | Hasegawa et al. | 162/358.4 |
| 6,174,825 | B1 | * | 1/2001 | Dutt | 442/43 |
| 6,284,102 | B1 | * | 9/2001 | Inoue et al. | 162/358.4 |
| 6,325,897 | B1 | * | 12/2001 | Ishino et al. | 162/358.4 |
| 6,406,414 | B1 | | 6/2002 | Matuschczyk | 492/48 |
| 6,440,274 | B1 | * | 8/2002 | Ikeda et al. | 162/358.4 |
| 6,584,688 | B1 | | 7/2003 | Matuschczyk | 29/895.32 |

FOREIGN PATENT DOCUMENTS

| | | | |
|---|---|---|---|
| DE | 43 40 344 | | 4/1994 |
| DE | 44 11 620 | * | 10/1995 |
| DE | 44 38 354 | | 5/1996 |
| DE | 196 54 194 | | 6/1998 |
| EP | 0 011 977 | A1 | 6/1980 |
| EP | 0 011 977 | B1 | 2/1983 |
| EP | 0 194 602 | | 3/1986 |
| EP | 0 328 844 | A1 | 9/1988 |
| EP | 0 328 844 | B1 | 9/1988 |
| EP | 0 420 372 | A1 | 2/1990 |
| EP | 0 420 372 | B1 | 2/1990 |
| EP | 0 534 041 | A1 | 12/1991 |
| EP | 0 534 041 | B1 | 12/1991 |
| EP | 0 538 211 | A1 | 1/1992 |
| EP | 0 538 211 | B1 | 1/1992 |
| EP | 0 541 498 | B1 | 2/1992 |
| EP | 0 473 430 | A2 | 3/1992 |
| EP | 0 473 430 | A3 | 3/1992 |
| EP | 0 576 115 | A1 | 2/1993 |
| EP | 0 576 115 | B1 | 2/1993 |
| EP | 0 695 827 | A2 | 2/1996 |
| EP | 0 473 430 | B1 | 3/1996 |
| EP | 0 761 873 | A1 | 3/1997 |
| EP | 0 695 827 | A3 | 5/1997 |
| EP | 0 815 948 | A1 | 1/1998 |
| EP | 0 877 119 | A2 | 11/1998 |
| EP | 0 877 119 | A3 | 2/1999 |
| EP | 0 922 806 | A2 | 6/1999 |
| EP | 0 922 806 | A3 | 8/1999 |
| EP | 0 969 143 | A2 | 1/2000 |
| EP | 0 761 873 | B1 | 4/2000 |
| EP | 1 096 065 | | 5/2001 |
| JP | 7-305291 | * | 11/1995 |
| JP | 11-350370 | | 12/1999 |
| WO | WO 92/02677 | | 2/1992 |
| WO | WO 95/25200 | | 9/1995 |
| WO | WO 95/29293 | | 11/1995 |
| WO | WO 96/12065 | | 4/1996 |
| WO | WO 98/15402 | | 4/1998 |
| WO | WO 98/24968 | | 6/1998 |
| WO | WO 99/14426 | | 3/1999 |
| WO | WO 99/54546 | | 10/1999 |

* cited by examiner

BELT FOR SHOE PRESS AND SHOE CALENDER AND METHOD FOR FORMING SAME

RELATED APPLICATIONS

This application claims priority from U.S. Provisional Patent Application Ser. No. 60/378,146, filed May 14, 2002, the disclosure of which is hereby incorporated herein by reference in its entirety.

FIELD OF THE INVENTION

The present invention relates generally to nip presses, and more particularly to shoe presses.

BACKGROUND OF THE INVENTION

In a typical papermaking process, a water slurry, or suspension, of cellulosic fibers (known as the paper "stock") is fed onto the top of the upper run of an endless belt of woven wire and/or synthetic material that travels between two or more rolls. The belt, often referred to as a "forming fabric," provides a papermaking surface on the upper surface of its upper run which operates as a filter to separate the cellulosic fibers of the paper stock from the aqueous medium, thereby forming a wet paper web. The aqueous medium drains through mesh openings of the forming fabric, known as drainage holes, by gravity or vacuum located on the lower surface of the upper run (i.e., the "machine side") of the fabric.

After leaving the forming section, the paper web is transferred to a press section of the paper machine, where it is passed through the nips of one or more presses (often roller presses) covered with another fabric, typically referred to as a "press felt." Pressure from the presses removes additional moisture from the web; the moisture removal is often enhanced by the presence of a "batt" layer of the press felt. The paper is then transferred to a dryer section for further moisture removal. After drying, the paper is ready for secondary processing and packaging.

Over the last 25 or 30 years, a "shoe press" has been developed for the press section of the papermaking machine. A shoe press includes a roll or similar structure that mates with a "shoe" of an opposed roll or press structure; the surface of the shoe is somewhat concave and approximates in curvature the convex profile of the mating roll. This arrangement can increase the width of the nip in the direction of paper travel, thereby enabling greater amounts of water to be removed therein.

Endless belts or blankets have traditionally been used in shoe press operations. The belt overlies and contacts the shoe of the press; in turn, a press felt such as that described above overlies the shoe press belt, and the paper web overlies the press felt. The shoe press belt and press felt travel through the nip and, in doing so, convey the paper web through the nip. The press felt is driven by a set of drive rollers arranged around the shoe or by the press roll itself. In older embodiments, shoe press belts were also driven by sets of drive rollers arranged around the shoe. In some newer configurations, however, the shoe press belt is clamped or otherwise fixed to the edges of circular head plates located on either end of the shoe, such that rotation of the head plates causes the shoe press belt to rotate and travel through the nip.

Given the performance requirements, a shoe press belt should be sufficiently flexible to pass around the drive rollers or head plates and through the shoe and sufficiently durable to withstand the repeated application of pressure within the nip. Because of these performance parameters, most endless belts are formed entirely or predominantly of a polymeric material (often polyurethane). Many shoe press belts also include reinforcing fibers or a reinforcing fabric between or embedded in polymeric layers. Also, shoe press belts may be configured to encourage water to pass from the paper web. To this end, some shoe press belts have grooves or blind-drilled holes in the surface adjacent the press felt that serve to vent water from the paper that is exiting the press felt.

Some of the issues that arise with the manufacture of a shoe press belt are the accurate placement of reinforcing fibers within the belt (and the application of material around them). Proposed approaches to the creation of shoe press belts are discussed in, for example, U.S. Pat. No. 5,525,194 to Jermo, U.S. Pat. No. 5,134,010 to Schiel, U.S. Pat. No. 5,320,702 to Matuschczyk, and U.S. Pat. No. 5,118,391 to Matuschczyk. However, there still exists a need for expediting and improving the manufacturing processes for shoe press belts.

SUMMARY OF THE INVENTION

The present invention can facilitate the production of shoe press belts, and in particular shoe press belts having axially-extending reinforcing fibers that are positioned radially inwardly of circumferentially-extending fibers. As a first aspect, the present invention is directed to an endless belt for a shoe press, comprising: a polymeric matrix formed into an endless loop; multiple bands of axial fibers, the fibers being embedded in the polymeric matrix, the bands including spacing material at each end that maintains a desired circumferential spacing between the fibers and further including securing structure that is adapted for securing the fibers to a mandrel; and circumferential fibers that circumferentially overlie and are spaced from the axial fibers, the circumferential fibers being embedded in the polymeric matrix. In some embodiments, the polymeric matrix comprises a base layer in which the axial fibers are embedded and a top stock layer that overlies the circumferential fibers. The sheet material and securing structure can maintain the axial fibers in a desired position and spacing during the production of the belt.

As a second aspect, the present invention is directed to an endless belt for a shoe press comprising: a polymeric base layer formed of a first polymeric material; axially extending fibers embedded in the base layer; circumferential fibers that circumferentially overlie the polymeric base layer; and a polymeric top stock layer that circumferentially overlies the circumferential fibers, the top stock layer being formed of a second polymeric material that differs from the first polymeric material. In this configuration, the belt can include one material that is particularly suited for contact with a shoe press and another material that is particularly suited for contact with a press felt.

As a third aspect, the present invention is directed to a method of producing an endless belt, comprising the steps of: securing axial fibers relative to a mandrel, the axial fibers being spaced apart from one another at desired intervals and extending substantially parallel to a longitudinal axis of the mandrel; applying a polymeric base layer to the mandrel in a thickness sufficient to embed the axial fibers; wrapping circumferential fibers onto the polymeric base layer with sufficient tension to partially embed the circumferential fibers in the polymeric base layer; applying a polymeric top stock layer over the polymeric base layer and circumferential fibers; and curing the base layer and the top stock layer. This method can improve productivity and performance of endless belts, particularly if the wrapping and latter applying steps closely follow the first applying step.

DETAILED DESCRIPTION OF THE INVENTION

Figure 1:
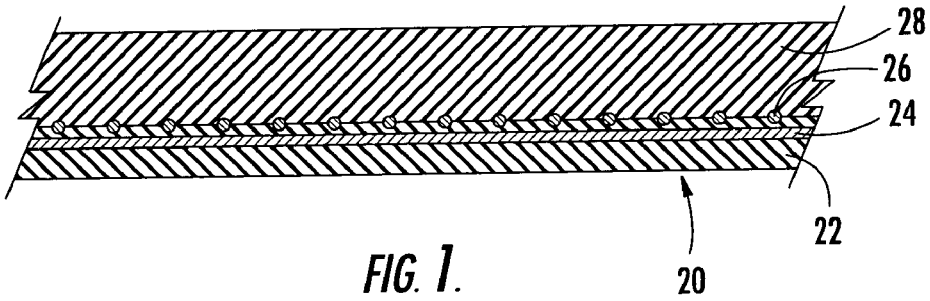
FIG. 1 is a front section view of a shoe press belt manufactured by the process of the present invention.

The present invention will now be described more fully hereinafter, in which preferred embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout. Thicknesses and dimensions of some components may be exaggerated for clarity.

Referring now to the drawings, a portion of a shoe press belt, designated broadly at 20, is illustrated in FIG. 1. The belt 20 has an endless looped polymeric matrix 21 that, in the illustrated embodiment, includes a base layer 22, axially-extending reinforcing fibers 24, circumferentially extending reinforcing fibers 26, and a top stock layer 28. In the illustrated embodiment, the base layer 22 completely encapsulates the axial fibers 24 (which are typically positioned about 0.025"–0.050" above the bottom surface of the base layer 22) and extends about 0.020" above the tops of the axial fibers 24. The circumferential fibers 26 are partially embedded (typically buried about halfway) in the base layer 22. The top stock layer 28 covers and seals the circumferential fibers 26; the top stock layer 28 cross-links with the base layer 22 and provides adequate thickness (typically between about 0.050 and 0.300 inches) for further finishing operations. A typical belt 20 may be between about 40 and 80 inches in diameter, 50 and 400 inches in length, and 0.100 and 0.300 inches in thickness.

Both the base layer 22 and top stock layer 28 are typically formed of a polyurethane-based material (i.e., one that is primarily formed of polyurethane), preferably one having a hardness of between about 29 and 60 on the Shore D scale, or alternatively may be formed of polyester. The material may have fillers, additives and the like (for exemplary materials, see U.S. Pat. No. 4,859,396 to Krenkel et al., the disclosure of which is hereby incorporated herein by reference in its entirety). It may be preferable to employ two different polyurethane-based materials for the base and top stock layers 22, 28. For example, a slightly harder material (e.g. one with a Shore D hardness of between about 29 and 45) may be used for the base layer 22, which will be in contact with the shoe of a shoe press, and a slightly softer material (e.g., one with a Shore D hardness of between about 45 and 60) may be used for the top stock layer 28, which will be in contact with a press felt.

The reinforcing fibers 24, 26 may be formed of any suitable reinforcing material, but will ordinarily be formed of polyester, aramid, liquid crystal polymer, or other high performance fibers between about 0.008 and 0.050 inches in diameter. The fibers 24, 26 may be monofilament or multifilament strands. It is also contemplated that the fibers 24, 26 make take a flat, ribbonlike form, as this configuration may provide performance and manufacturing advantages.

Those skilled in this art will appreciate that, although a shoe press belt is described herein, a belt of similar structure may also be employed as a shoe calender belt; reference herein to a belt for a shoe press in intended to also include a belt for a shoe calender.

Figure 2:
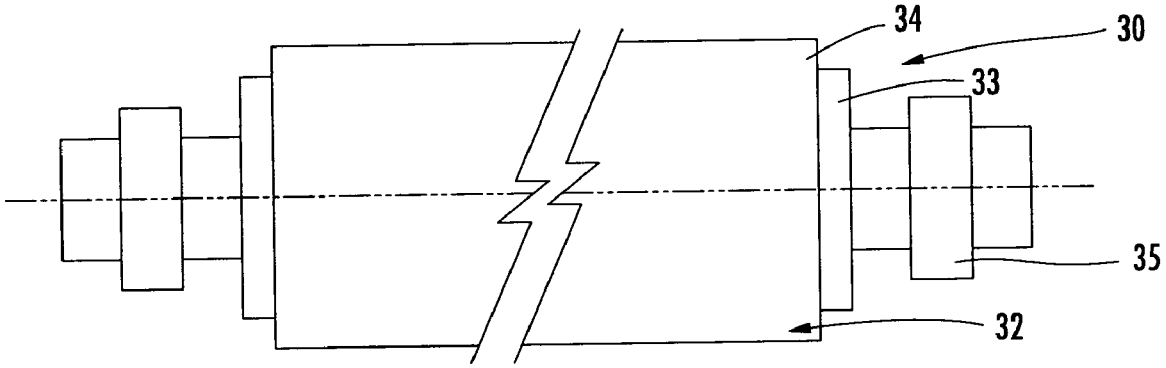
FIG. 2 is a front view of a mandrel employed in the process of the present invention.
Figure 3:
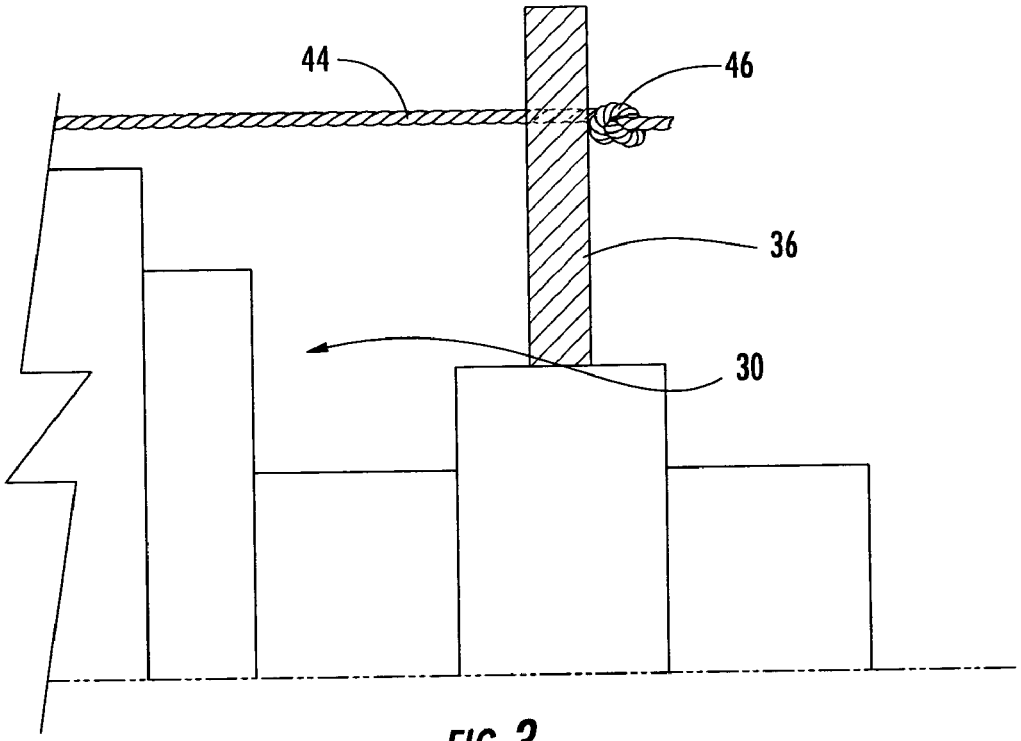
FIG. 3 is an enlarged partial front view of an end portion of the mandrel of FIG. 2 with axial fibers mounted thereon.
Figure 4:
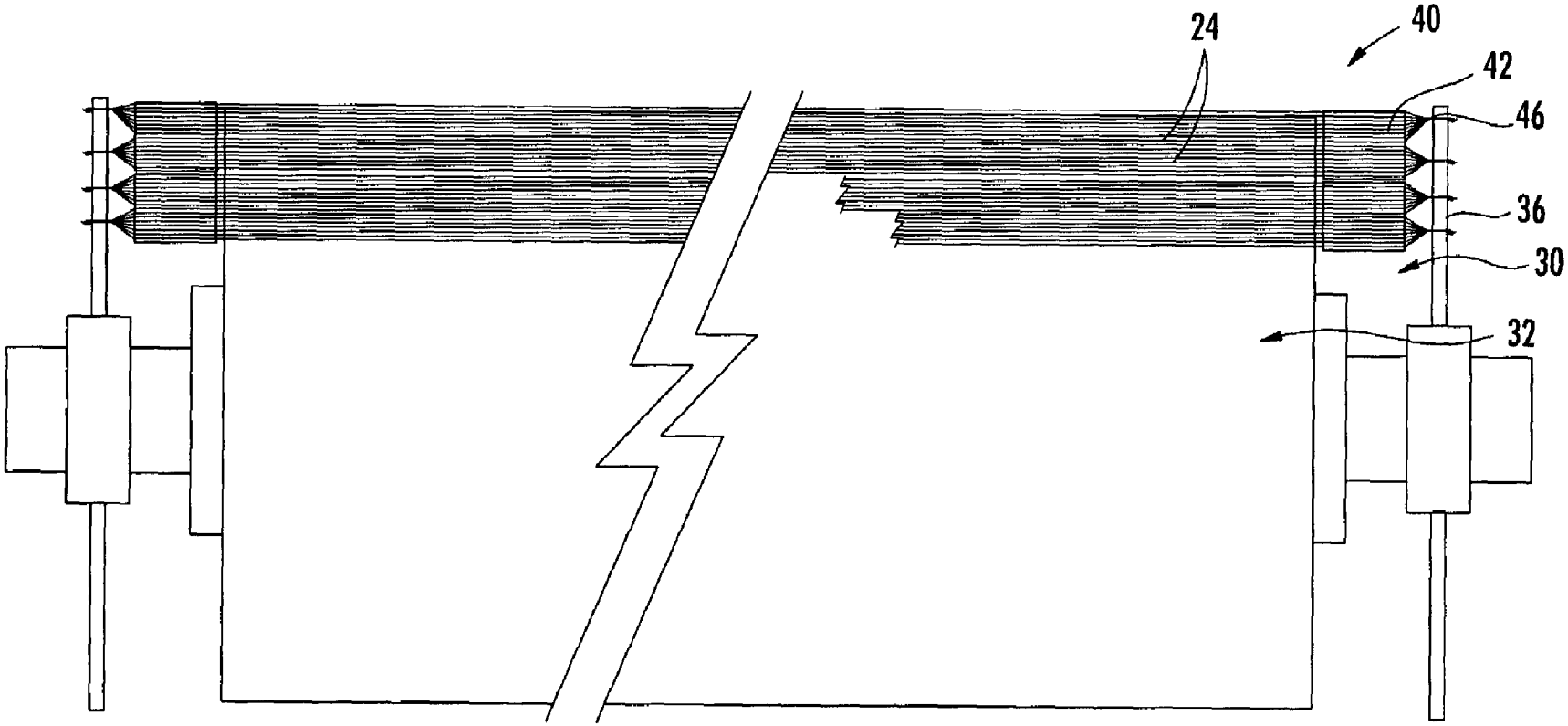
FIG. 4 is a front view of the mandrel of FIG. 2 with axial fibers mounted thereon.

Referring now to FIG. 2, the belt 20 may be formed on a mandrel 30. Ordinarily, the mandrel 30 is supported at either end by bearings 35 on which it is rotatably mounted. The mandrel 30 should have a cylindrical working surface 32 that is long enough to accommodate the largest anticipated paper machine working width (typically 400 inches), the additional length required to reach the shoe press heads (10–20 inches per end), the additional length required to form any belt tabs (10–20 inches per end) (see U.S. Pat. No. Re 33,034 to Schiel for a description of belt tabs), and the space required to start and end the rotational cast process (12 inches per end). The length of the working surface 32 should be selected accordingly.

Preferably, the mandrel 30 includes a slightly undersized inner metallic or composite core 33 and a hard outer layer 34 (formed of rubber or some other easily worked material) that provides the working surface 32. It is preferred that, if a separate outer layer is used and it is formed of an elastic or polymeric material, the outer layer is "bone-hard" (typically between 0 and 2 on the Pusey and Jones hardness scale), and that it be of sufficient thickness that, through grinding, the diameter can be modified to enable the formation of belts of slightly different diameters.

Prior to the application of polyurethane or other suitable polymeric material to the mandrel 30, provisions may be made to the working surface 32 to assist with belt removal. Exemplary surface treatments include coating with mold release, wrapping with sheets of Teflon® or other low friction material, or the like.

After the mandrel 30 has been prepared, the axial reinforcing fibers 24 are loaded onto the ends of the mandrel 30. In one embodiment of the invention, the axial fibers 24 are first formed into laminated multifiber bands (one of which is illustrated in FIGS. 3 through 6A and designated therein at 40). The band 40 includes a plurality of fibers 24 (for example, 70 at a time) strung in parallel relationship and laminated at each end with lamination sheets 42 or other sheet material. Adhesive on the lamination sheets 42 can adhere the sheets 42 together; alternatively, the lamination sheets 42 can be heat-bonded. Other spacing material, such as a slotted card, may also be used to maintain the axial fibers in a desired spacing.

In the illustrated embodiment, tails 44 of the fibers 24 extend beyond the lamination sheets 42 and are knotted together. The knotted portions 46 of the band 40 are then secured to the ends of the mandrel 30 with tensioning hooks (not shown) mounted in a ring 36 located on the end of the mandrel 30; if desired, the tensioning hooks may include a spring mechanism to maintain relatively consistent tension in the fibers 24. In other embodiments, a grommet (designated at 48 in FIG. 6B) or other suitable securing structure for attachment to the mandrel 30 may be included in the lamination sheets 42 in place of the knotted portions 46.

The lamination sheets 42 may maintain the fibers 24 at a desired uniform spacing between adjacent fibers 24 and at a desired distance from the working surface 32. Alternatively, a spacer ring or toothed belt or chain (not shown) can be attached to the ends of the mandrel 30 to maintain the fibers 24 in these positions.

Figure 5A:
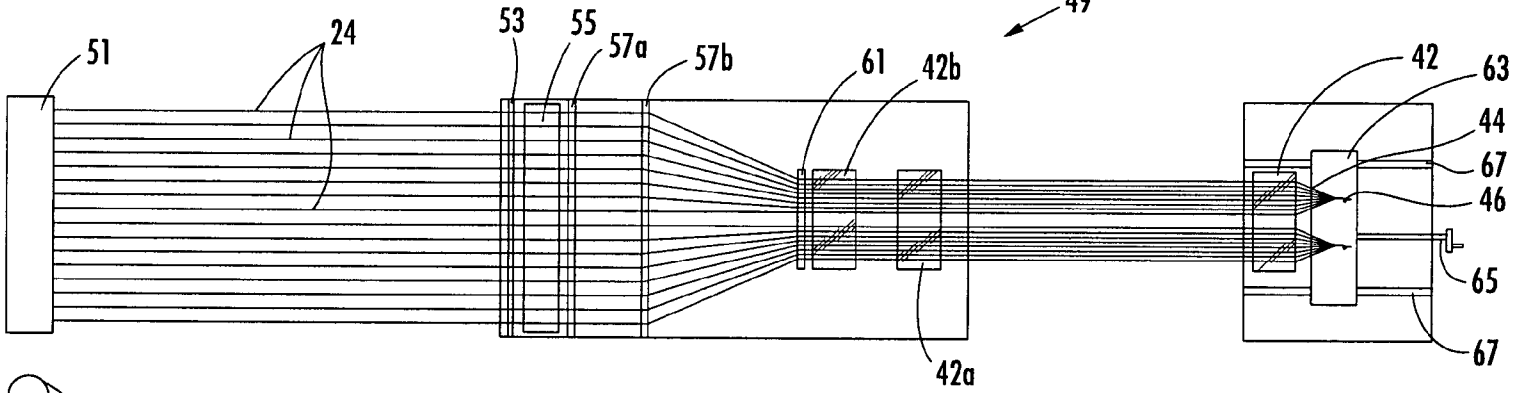
FIG. 5A is a top view of a band of axial fibers (including its laminated ends) to be included in a shoe press belt according to the present invention being formed on a fixture.
Figure 5B:
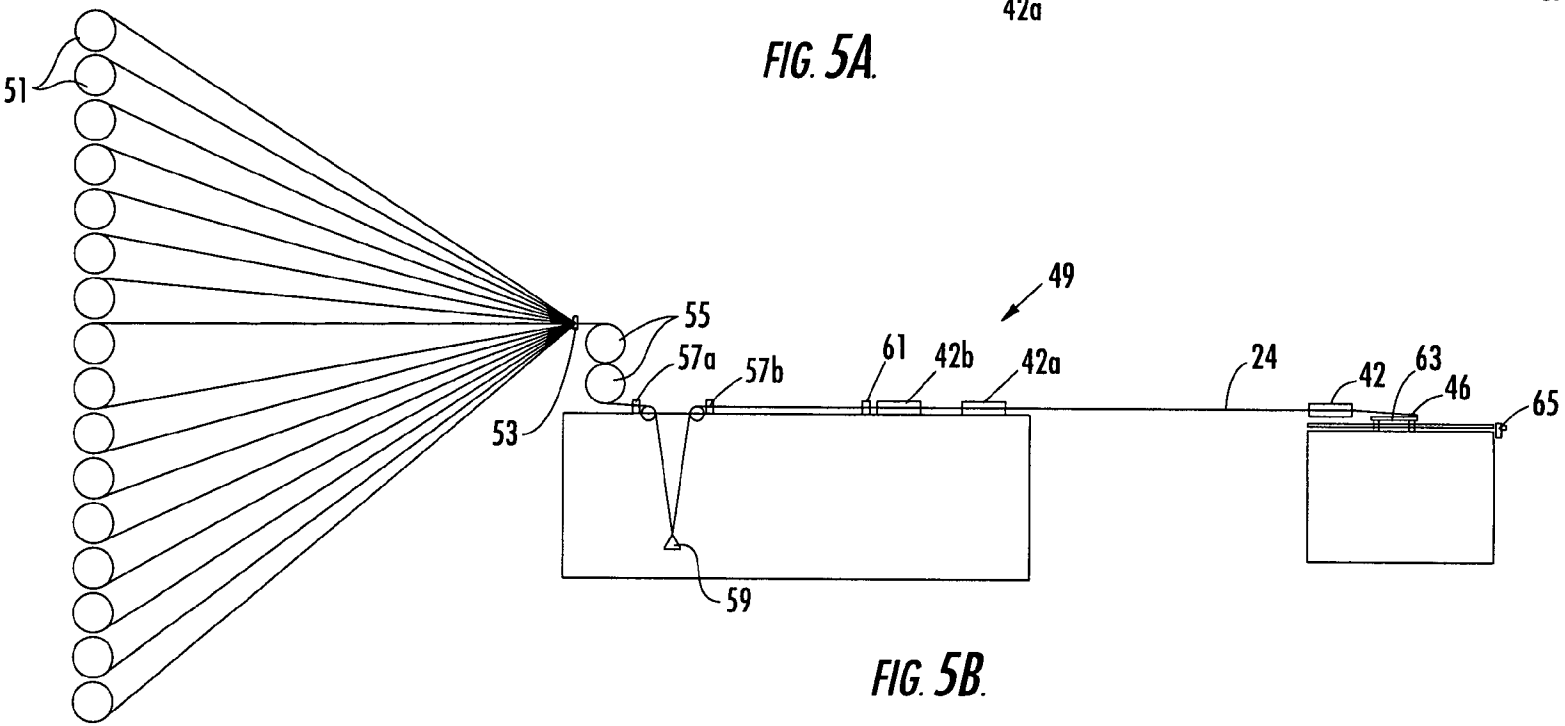
FIG. 5B is a front view of the band of axial fibers and the fixture of FIG. 5A.
Figure 6A:
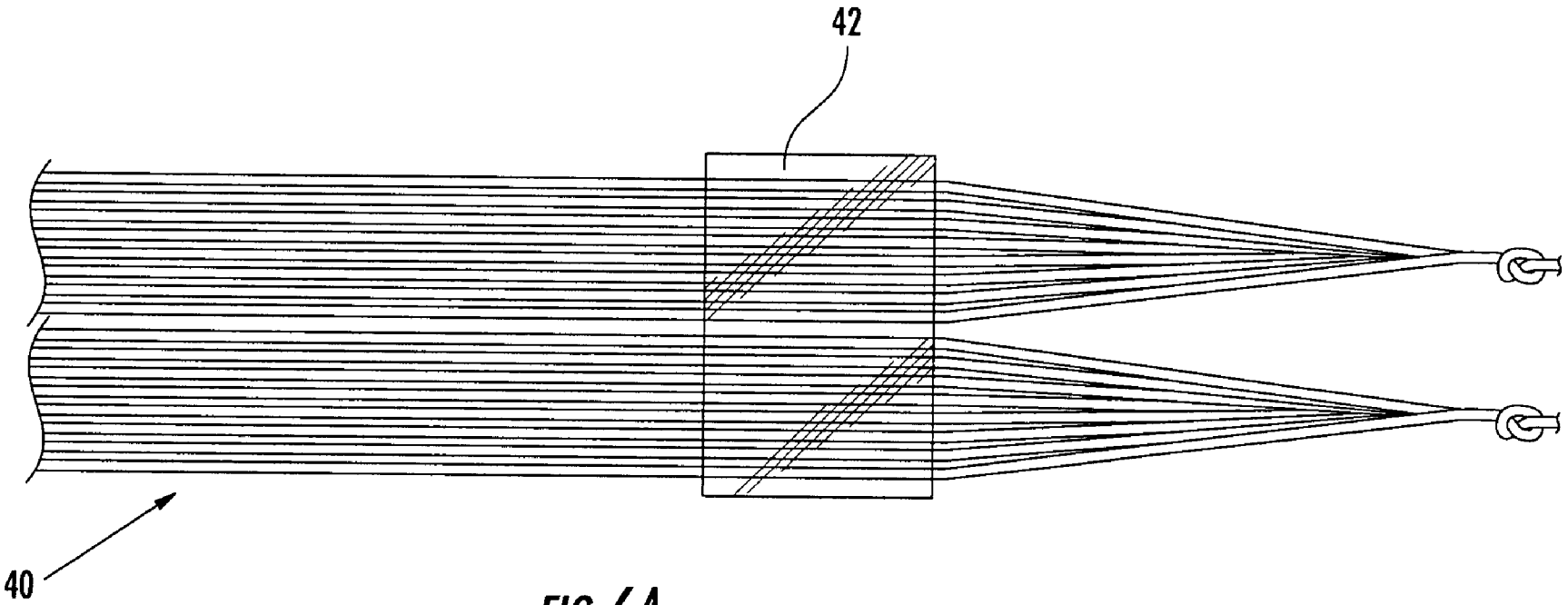
FIG. 6A is an enlarged top view of one end of the band of axial fibers of FIG. 5A.
Figure 6B:
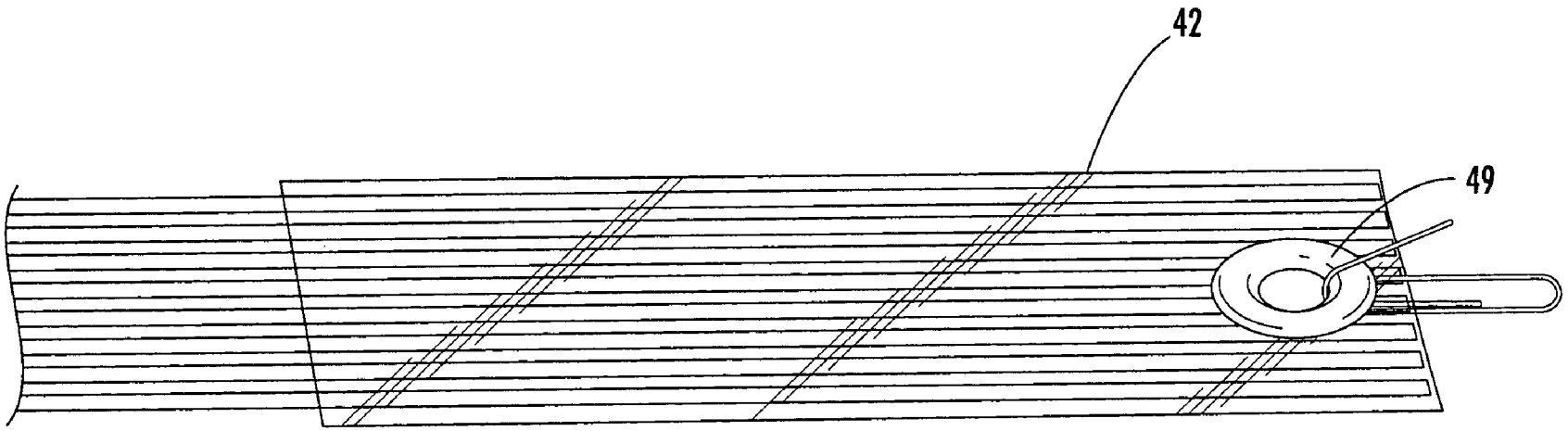
FIG. 6B is an enlarged top view of one end of an alternative laminated section of a band of axial fibers according to the present invention.

The axial fiber bands 40 can be formed, for example, with a fixture such as that designated at 49 in FIGS. 5A and 5B. Axial fibers 24 are dispensed from individual creels 51 and threaded sequentially through a spacer board 53, between vertically stacked rollers 55, through second and third spacer boards 57*a*, 57*b* (passing through a tensioning weight 59 between the spacer boards 57*a*, 57*b*), and through a narrower spacing card 61 that positions the fibers 24 in a desired regular gapped relationship (typically, the gap between adjacent fibers is between about 0.030 and 0.250 inches). The fibers 24, while remaining in the gapped relationship, extend to a platform 63 that slides on rails 67 (driven by a screw 65) away from the spacing card 61. The platform 63 includes hooks (not shown) onto which the knotted portions 46 of the band 40 are hooked.

Referring still to FIGS. 5A and 5B, the band 40 is produced by locking the holding rollers 55 so that the fibers 24 do not slip, creating a desired tension in the fibers 24 by sliding the platform 63 along the rails 67 with the screw 65, and laminating either one or, preferably and as shown, two sections of the fibers 24 near the spacer card 61 with the lamination sheets 42*a*, 42*b*. Doing so completes the production of one band 40, which now has lamination sheets 42, 42*a* on both ends, and begins the production of the next band 40, which now has one end laminated with lamination sheet 42*b*. The portions of the fibers 24 between the lamination sheets 42*a*, 42*b* are cut and knotted, the band 40 is removed and stored, and the lamination sheet 42*b* and its attached fibers are moved to and mounted on the platform 63 to complete the production cycle.

Figure 7:
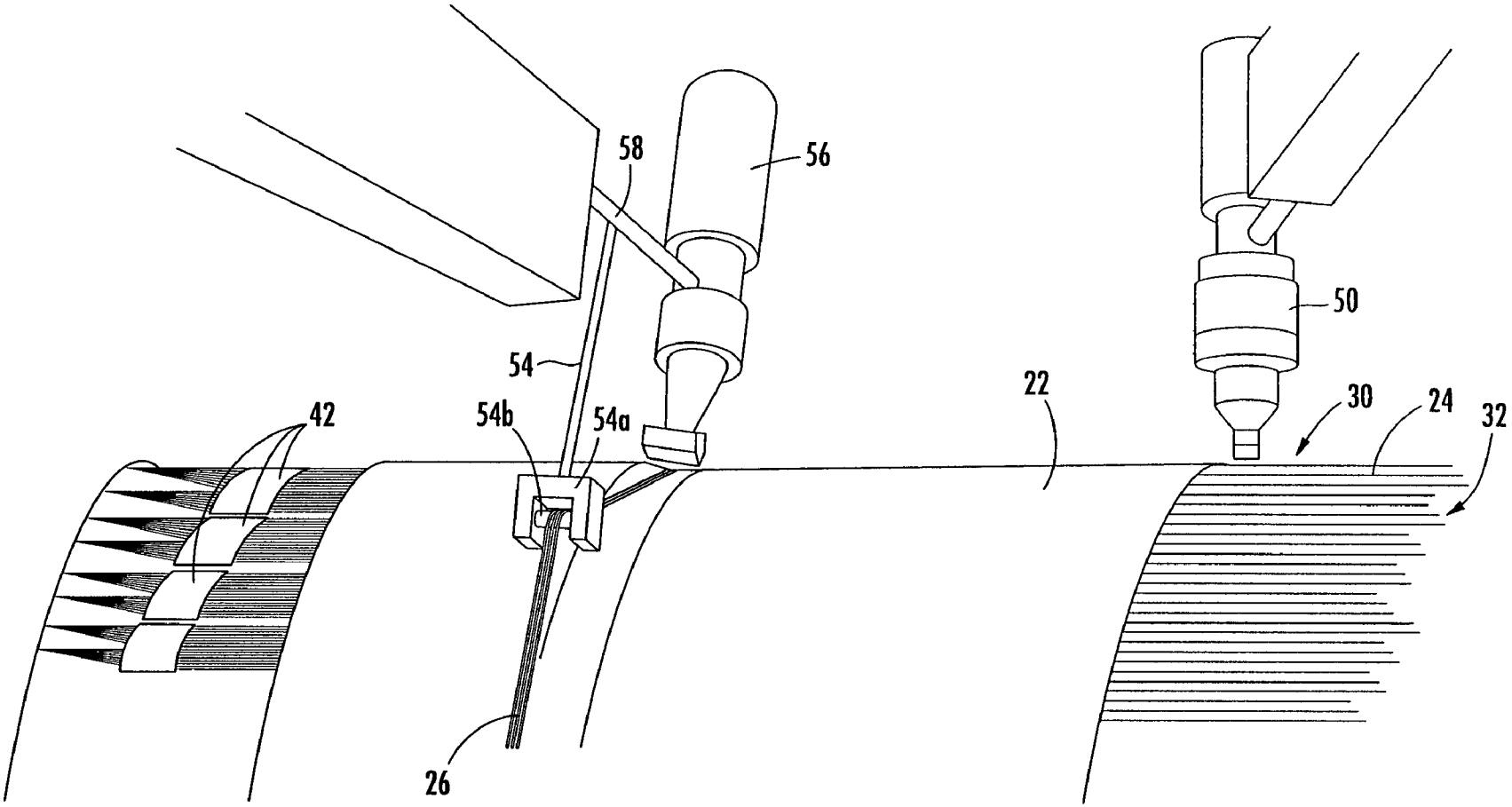
FIG. 7 is a perspective view of the mandrel of FIG. 2 with base layer and top stock nozzles and a circumferential fiber applicator.

Referring now to FIG. 7, after the axial fibers 24 have been loaded onto the mandrel 30 and are positioned as desired, the base layer 22 and circumferential fibers 26 are applied. The base layer 22 may be applied by a casting nozzle such as that designated at 50 in FIG. 7. The base layer 22 is preferably applied to a thickness that fully embeds the axial fibers 24 (a thickness that exceeds the top of the axial fibers 24 by about 0.020 inches is preferred. During application, the nozzle 50 begins at one end of the mandrel 30 and moves axially on a track (not shown) as the mandrel 30 rotates about its axis; in this manner, the working surface 32 of the mandrel 30 becomes coated with the base layer 22.

Referring still to FIG. 7, the circumferential fibers 26 are applied after application of the base layer 22 (preferably while the base layer 22 is still semi-soft) and before, during, or immediately after the application of the top stock layer 28 (in the illustrated embodiment, the circumferential fibers 26 are applied immediately before the application of the top stock layer 28). Individual creels of fibers (not shown) are mounted on a cart (also not shown) that is attached to and moves axially in concert with a nozzle 56 that applies the top stock layer 28; as many as six or more fibers 26 may be wound into the base layer 22 at once. In the illustrated embodiment, a rod 54 extends downwardly from the nozzle arm 58; the rod 54 has a forked lower end 54*a* that includes a cross-roller 54*b* over which the circumferential fibers 26 are fed prior to application to the base layer 22. The circumferential fibers 26 are tensioned by means known to those skilled in this art in order to control penetration of the circumferential fibers 26 into the base layer 22. Preferably, the circumferential fibers 26 are tensioned such that they are buried halfway (i.e. half of the cross-section of the fiber 26 is buried) in the base layer 22 (this tension is typically between about 0.25 and 5 pounds). It is also preferred that the top stock layer 28 be applied shortly after (i.e., within 15 minutes) or almost simultaneous with of the winding of the circumferential fibers 26, as doing so can encourage cross-linking between the base layer 22 and the top stock layer 28.

Those skilled in this art will recognize that a belt can be formed with a single material pass (i.e. formed as a one polymeric layer that embeds both the axial and the circumferential fibers 24, 26) rather than the two-shot process described above. In that instance the polymeric matrix 21 is a single unitary layer. Other embodiments may include more than two layers. Such embodiments may include one layer the embeds the axial fibers 24, another layer that embeds the circumferential fibers 26, and a third layer that provides the contact surface with a press felt.

After application of the top stock layer 28, the base layer 22 and top stock layer 28 of the polymer matrix 21 are cured to form the belt 20. Once the belt 20 has been cured, post-curing operations can be carried out as the belt 20 remains on the mandrel 30. Such operations may include trimming to the proper length and approximate thickness, grinding to its finished thickness, and venting (typically with the formation of blind drilled holes or grooves). Other operations are described in PCT Application No. US02/06520, filed Mar. 4, 2002, the disclosure of which is hereby incorporated herein in its entirety.

Once the post-curing processing of the belt 20 has been completed, the belt 20 is removed from the mandrel 30. Removal can be carried out in any manner known to those skilled in this art.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as recited in the claims. The invention is defined by the following claims, with equivalents of the claims to be included therein.

That which is claimed is:

1. An endless belt for a shoe press, comprising:

a polymeric matrix formed into an endless loop;

multiple bands of axial fibers, the fibers being embedded in the polymeric matrix, the bands including spacing material at each end that maintains a desired circumferential spacing between the fibers and further including securing structure that is adapted for securing the fibers to a mandrel; and circumferential fibers that circumferentially overlie and are spaced from the axial fibers, the circumferential fibers being embedded in the polymeric matrix.

2. The endless belt defined in claim 1, wherein the polymeric matrix includes an inner base layer, the axial fibers being embedded in the base layer, and an outer top stock layer that circumferentially overlies the base layer and the circumferential fibers.

3. The endless belt defined in claim 1, wherein the spacing material is a sheet material.

4. The endless belt defined in claim 1, wherein the securing structure is a grommet positioned in the spacing material.

5. The endless belt defined in claim 1, wherein the securing structure is a knot tied in the ends of one or more fibers in each band of axial fibers.

6. The endless belt defined in claim 1, wherein the axial and circumferential fibers are selected from the group consisting of polyester and aramid fibers.

7. The endless belt defined in claim 1, wherein the axial fibers are spaced between about 0.030 and 0.250 inches from each other.

8. The endless belt defined in claim 2, wherein the circumferential fibers are partially embedded in the base layer.

9. The endless belt defined in claim 2, wherein the base layer is formed of a first polymeric material, and the top stock layer is formed of a second polymeric material that differs from the first polymeric material.

10. A method of forming an endless belt for a shoe press, comprising the steps of:

securing axial fibers relative to a mandrel, the axial fibers being spaced apart from one another at desired intervals and extending substantially parallel to a longitudinal axis of the mandrel;

applying a polymeric base layer to the mandrel in a thickness sufficient to embed the axial fibers;

wrapping circumferential fibers onto the polymeric base layer with sufficient tension to partially embed the circumferential fibers in the polymeric base layer;

applying a polymeric top stock layer over the polymeric base layer and circumferential fibers; and curing the base layer and the top stock layer.

11. The method defined in claim 10, wherein the wrapping step comprises wrapping the circumferential fibers at a tension of between about 0.25 and 5 pounds.

12. The method defined in claim 10, wherein the axial and circumferential fibers are selected from the group consisting of polyester and aramid fibers.

13. The method defined in claim 10, wherein the base layer is formed of a first polymeric material, and the top stock layer is formed of a second polymeric material that differs from the first polymeric material.

14. The method defined in claim 13, wherein the first and second materials are polyurethane-based materials.

15. The method defined in claim 10, wherein the wrapping step immediately precedes the step of applying the top stock layer.

16. The method defined in claim 10, wherein the mandrel includes a polymeric outer surface.

17. A method of forming an endless belt for a shoe press, comprising the steps of:

securing axial fibers relative to a mandrel, the axial fibers being spaced apart from one another at desired intervals and extending substantially parallel to a longitudinal axis of the mandrel; the axial fibers being maintained in spaced relationship by a spacing material applied at the ends of the fibers;

applying a polymeric base layer to the mandrel in a thickness sufficient to embed the axial fibers;

wrapping circumferential fibers onto the polymeric base layer;

applying a polymeric top stock layer over the polymeric base layer and circumferential fibers; and curing the base layer and the top stock layer.

18. The method defined in claim 17, wherein the spacing material is a sheet material.

19. The method defined in claim 17, wherein the axial fibers are arranged as multiple bands of fibers, each of the bands of fibers being secured relative to the mandrel.

20. The method defined in claim 18, wherein the fibers are secured relative to the mandrel with a securing structure.

21. The method defined in claim 20, wherein the securing structure is one of a knot formed from the ends of the fibers and a grommet positioned in the sheet material.

22. The endless belt defined in claim 17, wherein the axial and circumferential fibers are selected from the group consisting of polyester and aramid fibers.

23. The endless belt defined in claim 17, wherein the axial fibers are spaced between about 0.030 and 0.250 inches from each other.

24. The endless belt defined in claim 17, wherein the wrapping step causes the circumferential fibers to become partially embedded in the base layer.

25. The endless belt defined in claim 17, wherein the wrapping step immediately precedes the step of applying a top stock layer.

26. The endless belt defined in claim 17, wherein the wrapping step is performed prior to curing of the base layer.

27. The endless belt defined in claim 17, wherein curing of the base and top stock layers occurs simultaneously.

* * * * *